US005271659A

United States Patent [19]

Zinkevicz

[11] Patent Number: 5,271,659

[45] Date of Patent: Dec. 21, 1993

[54] PORTABLE SEAT

[76] Inventor: Scott J. Zinkevicz, 2024 West Main St., Richmond, Va. 23220

[21] Appl. No.: 795,001

[22] Filed: Nov. 18, 1991

[51] Int. Cl.[5] ..... A47C 1/00

[52] U.S. Cl. ..... 297/4; 297/284.6; 297/DIG. 3

[58] Field of Search ..... 297/4, DIG. 3, 284.6, 297/180; 5/455, 449, 456, 654; 446/220

[56] References Cited

U.S. PATENT DOCUMENTS

| | | | |
|---|---|---|---|
| 1,468,072 | 9/1923 | Ogle | 297/4 X |
| 1,626,166 | 4/1927 | Stair | 297/4 X |
| 1,723,831 | 8/1929 | Weymouth | 297/4 |
| 2,689,812 | 9/1954 | Mollica et al. | 52/2.11 X |
| 2,829,386 | 4/1958 | Peer | 297/4 X |
| 2,990,070 | 6/1961 | Cushman | 297/DIG. 3 |
| 3,062,580 | 11/1962 | Jasmin, Jr. | 297/4 |
| 3,185,362 | 5/1965 | Wakefield | 297/4 X |
| 3,705,429 | 12/1972 | Nail | 5/455 |
| 4,547,919 | 10/1985 | Wang | 5/455 |
| 4,588,224 | 5/1986 | Hill, Jr. | 297/4 |
| 4,724,560 | 2/1988 | Christie | 5/455 X |
| 4,759,543 | 7/1988 | Feldman | 297/DIG. 3 X |
| 4,833,813 | 5/1989 | McLemore, Jr. | 446/220 X |

FOREIGN PATENT DOCUMENTS

| | | | |
|---|---|---|---|
| 0583024 | 12/1977 | U.S.S.R. | 5/455 |
| 0420292 | 11/1934 | United Kingdom | 5/455 |
| 1455550 | 11/1976 | United Kingdom | 5/455 |

*Primary Examiner*—James R. Brittain
*Assistant Examiner*—Milton Nelson, Jr.
*Attorney, Agent, or Firm*—S. Michael Bender

[57] ABSTRACT

A portable seat is constructed of a thin, lightweight, shell of Goretex material and then lined with Thinsulate material or some similar heat retaining fabric. The waterproof seat is attachable by VELCRO fabric fasteners or a belt to the seat portion of a user's trousers, and is particularly useful on ski lifts and the like. When not being used, the seat can be folded and stored in a small pouch. A modified embodiment of the seat employs an inflatable cushion with its comfort being adjustable through the use of further inflatable coiled springs positioned within the main cushion. Both the main seat cushion and each of the inflatable springs may be independently inflated to adjust comfort.

2 Claims, 4 Drawing Sheets

PORTABLE SEAT

BACKGROUND OF THE INVENTION

1. Field of the Invention

The present invention relates to detachable cushions and more particularly pertains to a portable seat cushion designed to be attached directly to a user's clothing.

2. Description of the Prior Art

The use of detachable cushions is known in the prior art. However, these cushions are generally designed to be attached to existing seat structures and not to the body or clothing of a particular user. A good typical example of a prior art detachable cushion is to be found in U.S. Pat. No. 4,212,496 which issued to A. Kirkham, Jr. on Jul. 15, 1980. This patent discloses a detachable cushion for the seat of ski lift chairs and is usable for the purpose of providing some measured degree of comfort and dryness to a chair user. However, when a ski lift chair is not being utilized, it is continually exposed to ambient weather conditions which effects both its comfort and dryness. As such, there appears to exist a need for some type of cushion which could be utilized on a ski lift chair or under similar conditions wherein such cushion could be maintained in a dry condition until its use is necessitated. In this respect, the present invention substantially fulfills this need.

SUMMARY OF THE INVENTION

In view of the foregoing disadvantages inherent in the known types of detachable cushions now present in the prior art, the present invention provides an improved detachable cushion seat construction wherein the same can be attached directly to the person or clothing of a user. As such, the general purpose of the present invention, which will be described subsequently in greater detail, is to provide a new and improved detachable cushioned seat which has all the advantages of the prior art detachable cushioned seats and none of the disadvantages.

To attain this, the present invention essentially comprises a portable seat which is constructed of a thin, lightweight shell of Goretex material and then lined with Thinsulate material or some similar heat retaining fabric. The waterproof seat is attachable by Velcro or a belt to the seat portion of a user's trousers, and is particularly useful on ski lifts and the like. When not being used, the seat can be folded and stored in a small pouch. A modified embodiment of the seat employs an inflatable cushion with its comfort being adjustable through the use of further inflatable coiled springs positioned within the main cushion. Both the main seat cushion and each of the inflatable springs may be independently inflated to adjust comfort.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved detachable cushion seat which has all the advantages of the prior art detachable cushion seats and none of the disadvantages.

It is another object of the present invention to provide a new and improved detachable cushion seat which may be easily and efficiently manufactured and marketed.

It is a further object of the present invention to provide a new and improved detachable cushion seat which is of a durable and reliable construction.

An even further object of the present invention is to provide a new and improved detachable cushion seat which is susceptible of a low cost of manufacture with regard to both materials and labor, and which accordingly is then susceptible of low prices of sale to the consuming public, thereby making such detachable cushion seats economically available to the buying public.

Still yet another object of the present invention is to provide a new and improved detachable cushion seat which provides in the apparatuses and methods of the prior art some of the advantages thereof, while simultaneously overcoming some of the disadvantages normally associated therewith.

Still another object of the present invention is to provide a new and improved detachable cushion seat which can be attached directly to the person or clothing of a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
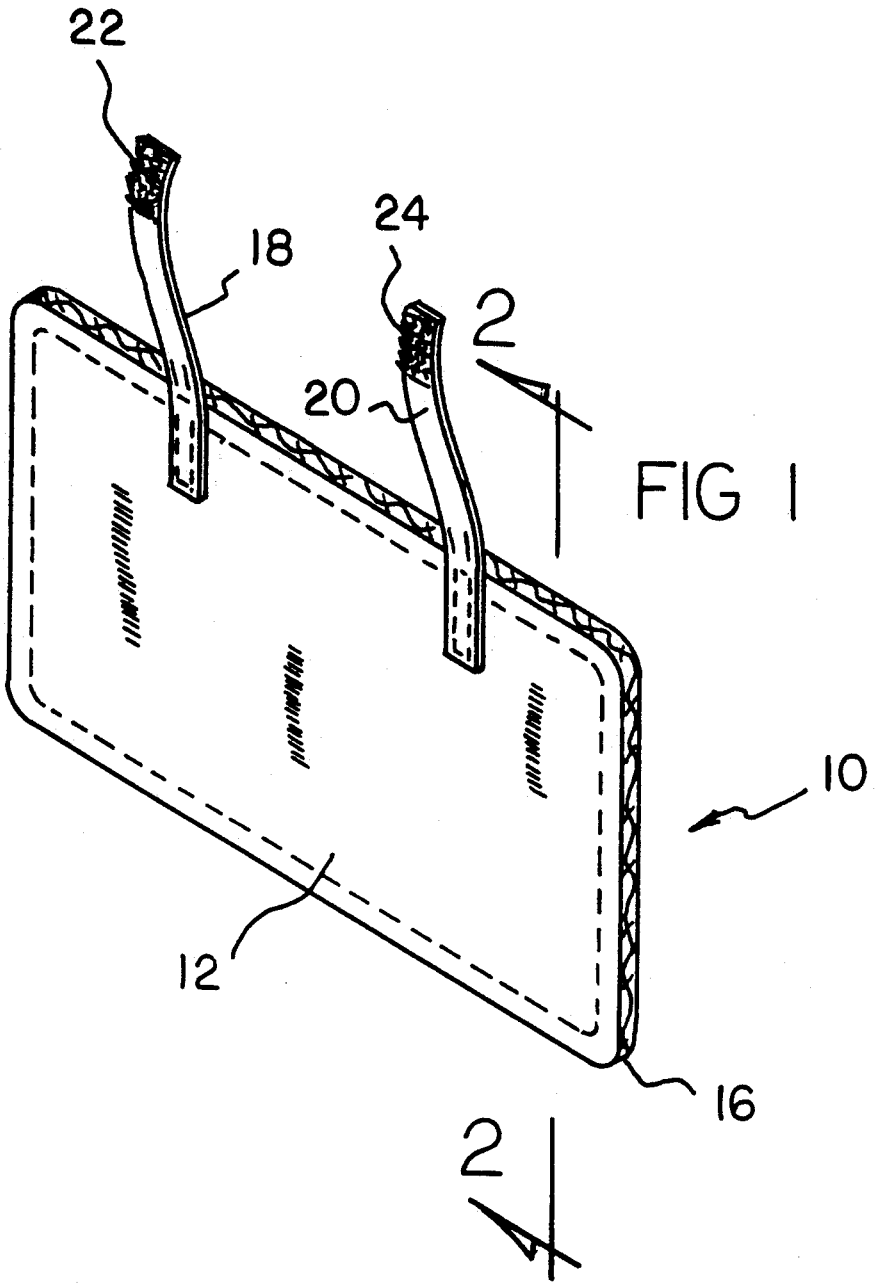
FIG. 1 is a perspective view of a first embodiment of a detachable cushion seat embodying the principles and concepts of the present invention.
Figure 2:
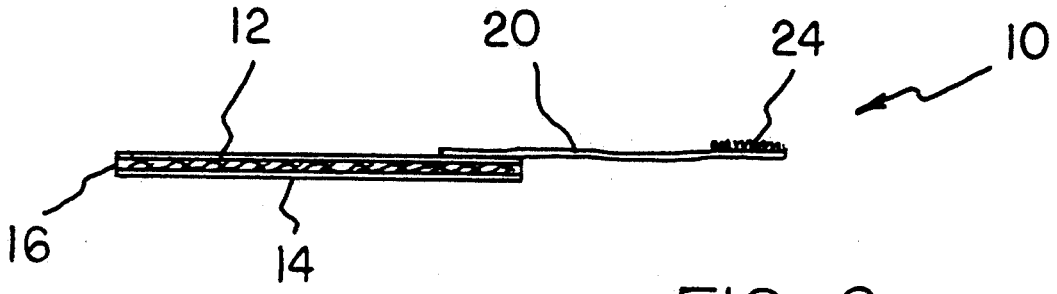
FIG. 2 is a cross-sectional view of the invention as viewed along the 2—2 in FIG. 1.

With reference now to the drawings, and in particular to FIGS. 1 and 2 thereof, a new and improved detachable cushion seat embodying the principles and concepts of the present invention and generally designated by the reference numeral 10 will be described.

More specifically, it can be seen that the detachable cushion seat 10 comprises an outer flexible shell formed from two layers of a rugged and quick drying material 12, 14 such as Goretex material or the like. The two layers of Goretex material 12, 14 are stitched together and sandwiched between the layers is a further thin liner material 16 such as Thinsulate material or some similar insulating material. In the preferred embodiment, the edges of all three layers of material 12, 14, 16 are exposed to the ambient atmosphere to facilitate a rapid drying. A pair of straps 18, 20 are sewn to one side of the seat 10, and the free ends of the straps are provided with hook and loop fastening material 22, 24 respectively.

Figure 3:
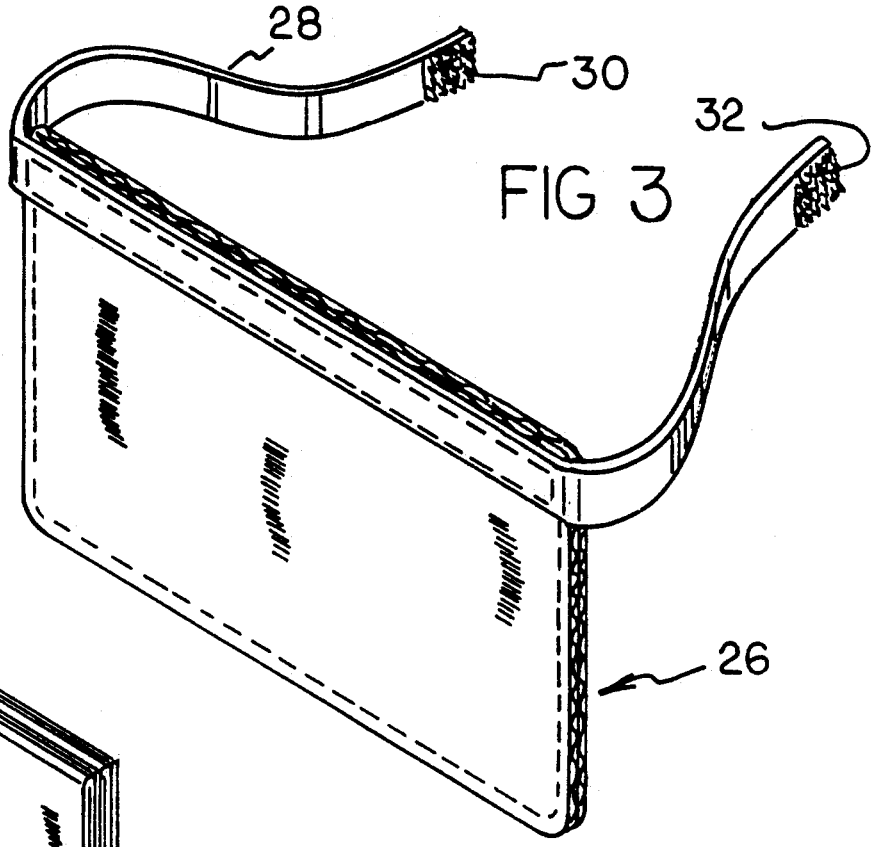
FIG. 3 is a perspective view of a second embodiment of the invention.
Figure 4:
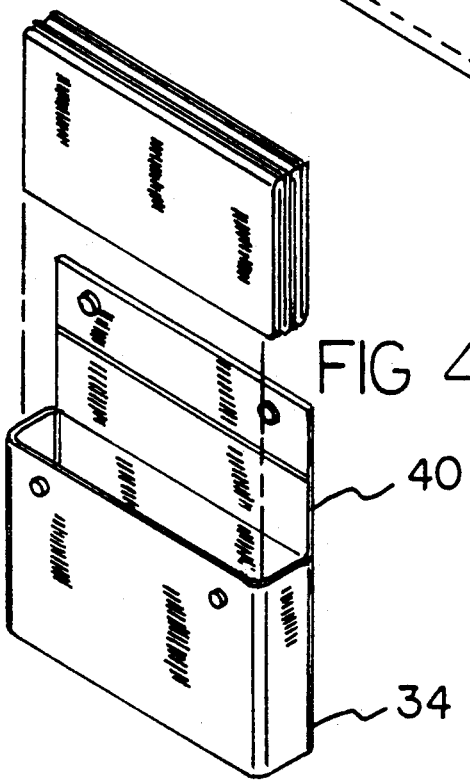
FIG. 4 is a perspective view of a pouch which can be utilized to carry the invention.
Figure 7:
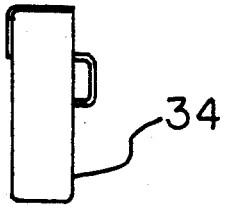
FIG. 7 is an end elevation view of the pouch as viewed along the line 7—7 in FIG. 5.
Figure 5:
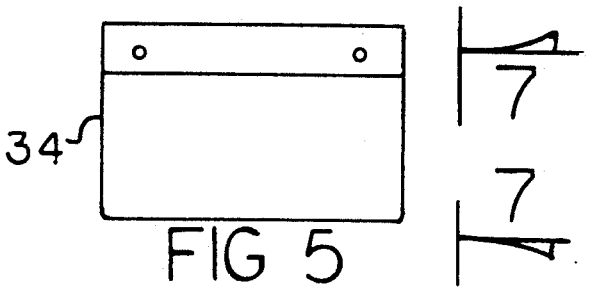
FIG. 5 is a front elevation view of the pouch.
Figure 6:
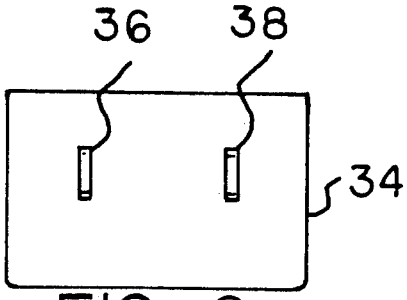
FIG. 6 is a rear elevation view of the pouch.

FIG. 3 of the drawings illustrates a modified embodiment of the invention which is generally designated by the reference numeral 26. The embodiment 26 is substantially similar to the embodiment 10 with the exception that the straps 18, 20 have been replaced with a nylon belt 28 which has the cushion per se sewn thereto in a middle portion thereof. Ends of the belt 28 are provided with hook and loop fasteners 30, 32 to facilitate its attachment around the waist of a user.

FIGS. 4–7 illustrate a typical pouch 34 which may be utilized to store either of the embodiments 10, 26 of the detachable seat cushion when the same is not being utilized. The pouch 34 may include appropriate belt loops 36, 38 to facilitate its attachment to a user's clothing, and a top flexible closure 40 may be snapped shut to protect the cushions 10, 26 prior to their use.

Figure 8:
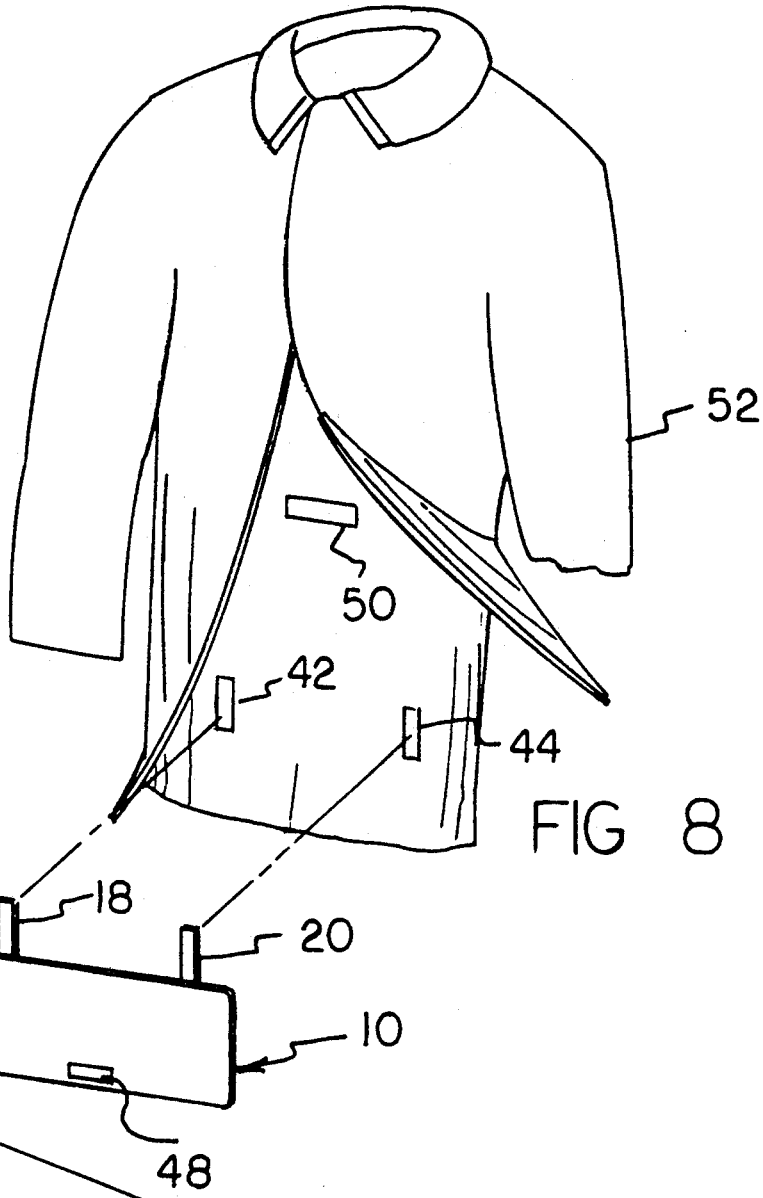
FIG. 8 is a perspective illustration of the manner of using the present invention.
Figure 9:
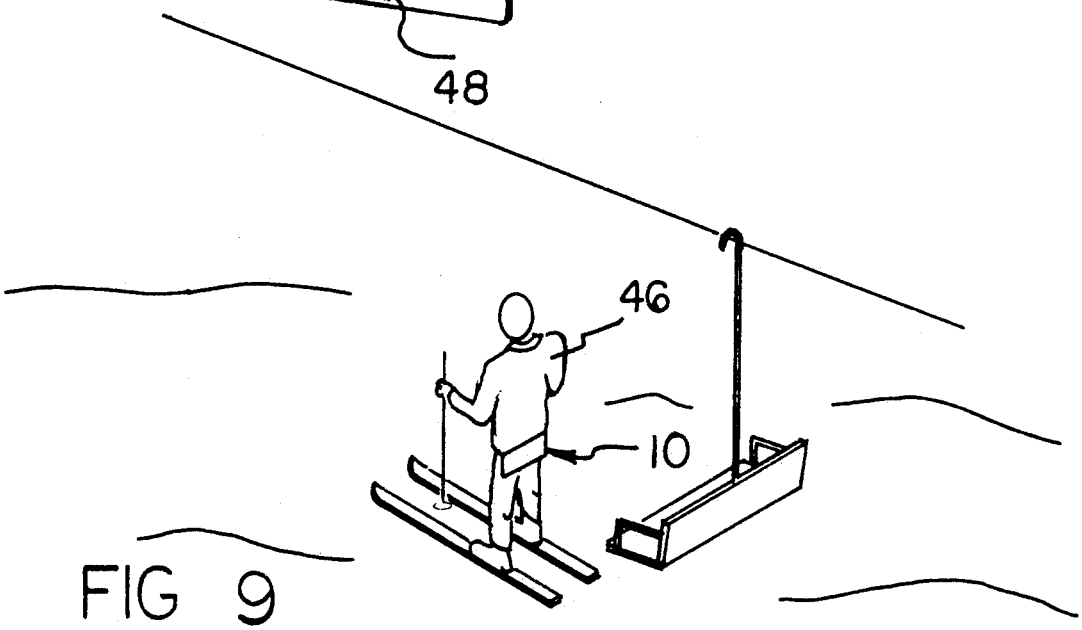
FIG. 9 is a further illustration of how to utilize the invention.

FIGS. 8 and 9 of the drawings illustrate the versatility of use of the embodiments 10, 26 of the invention. In this regard, it can be seen that the cushion 10 may have its holding straps 18, 20 attached to hook and loop fastening strips 42, 44 positioned under a jacket or shirt of a user. When so positioned, the detachable seat cushion would hang over the buttocks of a user 46 as best illustrated in FIG. 9. When it is not desired to utilize the cushion 10, a further strip of hook and loop fastening material 48 attached to a surface of the cushion 10 may be brought into engagement with another strip of hook and loop fastening material 50 positioned beneath the jacket of the user This allows the cushion 10 to be folded up under the user's jacket 52 so as to protect it from the weather until a further use is required.

Figure 10:
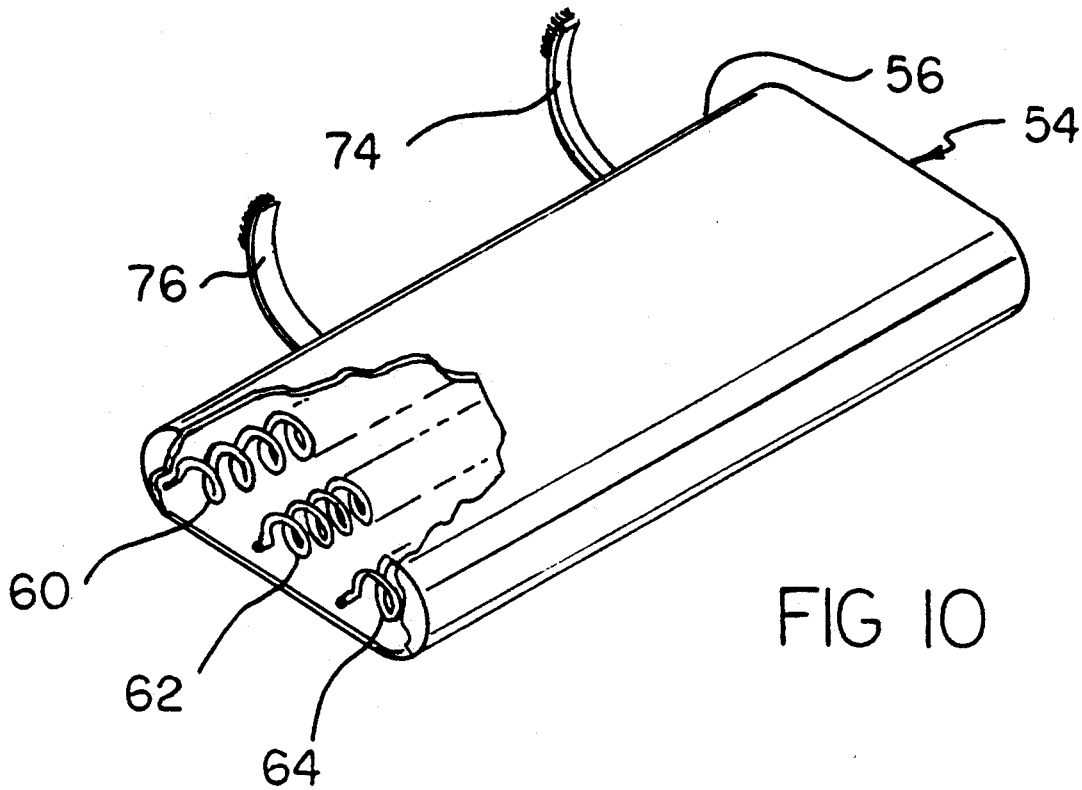
FIG. 10 is a partial perspective view illustrating a third embodiment of the invention.
Figure 11:
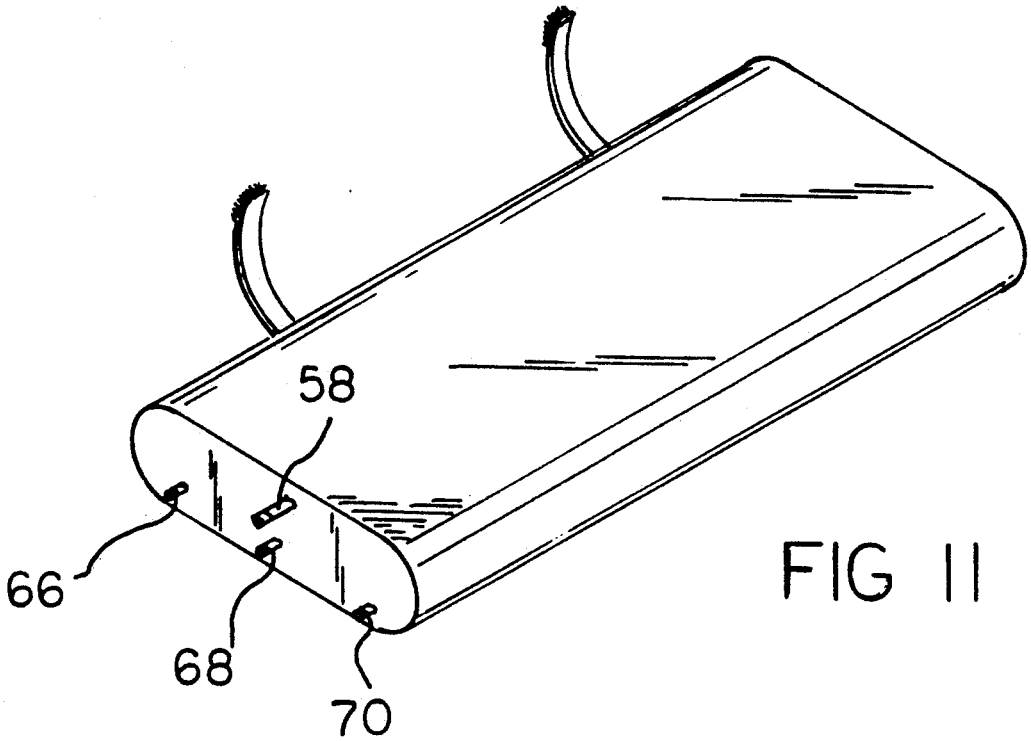
FIG. 11 is a further perspective view of the third embodiment of the invention.

While the preferred embodiments 10, 26 of the invention have now been described, FIGS. 10 and 11 illustrate the versatility of design available with the present invention and are intended to illustrate the many different features which could be added thereto to improve their performance. In this regard, a third embodiment of the invention which is generally designated by the reference numeral 54 utilizes an inflatable cushion 56 having a conventional inflation valve 58. To vary the comfort factor of the cushion 54, three inflatable coiled tubes 60, 62, 64 are permanently retained within the inflatable cushion 56 and each of these coiled inflatable tubes have respective manually operable inflation valves 66, 68, 70. The inflatable coiled tubes 60, 62, 64 operate as springs to maintain the longitudinal expansion of the inflatable cushion 56, while at the same time they operate to provide a very distinct comfort factor. Velcro attachment straps 72, 74 are then provided for the purpose of utilizing the cushion 54 in the manner of the afore-described cushion 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved detachable cushion seat comprising:

main inflatable cushion means; said main inflatable cushion means being substantially rectangularly shaped and having a major longitudinal extent and a minor transverse extent, a pair of opposed edges parallel to said longitudinal extent and a pair of opposed edges parallel to said transverse extent, and strap means for permitting an attachment of said detachable cushion seat directly to existing clothing of a user, said strap means being attached to and extending from one of said opposed edges of said main inflatable cushion means parallel to said longitudinal extent thereof, wherein said strap means are provided with hook and loop fasteners to facilitate an attachment of said detachable cushion to said clothing, and further including at least one inflatable coiled tube retained within said inflatable main cushion means, said main inflatable cushion means and said at least one inflatable coiled tube being independently inflatable to facilitate an adjustment of comfort for a user, wherein said at least one inflatable coiled tube is coiled about a central longitudinal axis and said longitudinal axis extends substantially parallel to said longitudinal extent of said main inflatable cushion means and substantially perpendicular tot he opposed edges of said main inflatable cushion means parallel to said transverse extent of said cover means.

2. The new and improved detachable cushion seat of claim 4 further including a multiplicity of said inflatable coiled tubes spaced from each other along the minor transverse extent of said main inflatable cushion means and being substantially parallel to each other and to said major longitudinal extent of said main inflatable cushion means, and wherein said multiplicity comprises three in number.

* * * * *